US010221663B2

(12) United States Patent
Romer et al.

(10) Patent No.: US 10,221,663 B2
(45) Date of Patent: Mar. 5, 2019

(54) WIRELINE-DEPLOYED POSITIVE DISPLACEMENT PUMP FOR WELLS

(71) Applicants: Michael C. Romer, The Woodlands, TX (US); Randy C. Tolman, Spring, TX (US); Louis-Claude Porel, Jeanmenil (FR); Francois Ramon Leon Porel, Sainte-Pole (FR)

(72) Inventors: Michael C. Romer, The Woodlands, TX (US); Randy C. Tolman, Spring, TX (US); Louis-Claude Porel, Jeanmenil (FR); Francois Ramon Leon Porel, Sainte-Pole (FR)

(73) Assignee: ExxonMobil Upstream Research Company, Spring, TX (US)

( * ) Notice: Subject to any disclaimer, the term of this patent is extended or adjusted under 35 U.S.C. 154(b) by 188 days.

(21) Appl. No.: 15/286,665

(22) Filed: Oct. 6, 2016

(65) Prior Publication Data

US 2017/0167237 A1 Jun. 15, 2017

Related U.S. Application Data

(60) Provisional application No. 62/265,144, filed on Dec. 9, 2015.

(51) Int. Cl.

| | |
|---|---|
| ***E21B 43/12*** | (2006.01) |
| ***E21B 47/00*** | (2012.01) |
| ***F04B 47/06*** | (2006.01) |
| ***F04B 49/20*** | (2006.01) |
| ***F04B 43/02*** | (2006.01) |

(52) U.S. Cl.

CPC ..... *E21B 43/128* (2013.01); *E21B 43/127* (2013.01); *E21B 47/0007* (2013.01); *F04B 43/02* (2013.01); *F04B 47/06* (2013.01); *F04B 49/20* (2013.01)

(58) Field of Classification Search

CPC ..... E21B 43/128

See application file for complete search history.

(56) References Cited

U.S. PATENT DOCUMENTS

| | | | | |
|---|---|---|---|---|
| 5,901,632 | A | 5/1999 | Ryan | |
| 5,931,076 | A | 8/1999 | Ryan | |
| 6,017,198 | A | 1/2000 | Traylor et al. | |
| 2008/0003118 | A1 | 1/2008 | Traylor et al. | |
| 2008/0080991 | A1 | 4/2008 | Yuratich et al. | |
| 2010/0211226 | A1 | 8/2010 | Dowling et al. | |
| 2011/0311374 | A1 | 12/2011 | Ocalan et al. | |
| 2013/0175030 | A1* | 7/2013 | Ige | E21B 43/128 166/250.15 |

* cited by examiner

*Primary Examiner* — Giovanna C. Wright

(74) *Attorney, Agent, or Firm* — ExxonMobil Upstream Research Company—Law Department

(57) ABSTRACT

Disclosed techniques include a method of removing wellbore liquid from a wellbore that extends within a subterranean formation, comprising positioning a pump downhole in the wellbore, electrically powering the pump, expanding and contracting a membrane by pumping a fluid with the pump, wherein expanding and contracting the membrane creates a pressure for removing the wellbore liquid from the well, and removing the wellbore liquid from the well using the pressure.

21 Claims, 6 Drawing Sheets

WIRELINE-DEPLOYED POSITIVE DISPLACEMENT PUMP FOR WELLS

CROSS REFERENCE TO RELATED APPLICATIONS

This application claims the benefit of U.S. Provisional Application Ser. No. 62/265,144 filed Dec. 9, 2015, entitled, "Wireline-Deployed Positive Displacement Pump for Wells," the entirety of which is incorporated by reference herein.

This application is related to U.S. Provisional Application Ser. No. 62/173,194 filed Jun. 9, 2015 entitled, "Battery-Powered Pump for Removing Fluids from a Subterranean Well,", U.S. Provisional Application Ser. No. 62/236,538 filed Oct. 2, 2015 entitled, "Flushable Velocity Fuse and Screen Assembly for Downhole Systems,", U.S. Provisional Application Ser. No. 62/237,109 filed Oct. 5, 2015 entitled, "Apparatus for Wireline Pickup Weight Mitigation and Methods Therefor,", and U.S. Provisional Application Ser. No. 62/241,395 filed Oct. 14, 2015 entitled, "Synthetic Power Cable for Downhole Electrical Devices," the entireties of which are incorporated by reference herein.

FIELD OF THE INVENTION

The present disclosure is directed generally to systems and methods for artificial lift in a wellbore and more specifically to systems and methods that utilize a downhole pump to remove a wellbore liquid from the wellbore.

BACKGROUND

A hydrocarbon well may be utilized to produce gaseous hydrocarbons from a subterranean formation. Often, a wellbore liquid may build up within one or more portions of the hydrocarbon well. This wellbore liquid, which may include water, condensate, and/or liquid hydrocarbons, may impede flow of the gaseous hydrocarbons from the subterranean formation to a surface region via the hydrocarbon well, thereby reducing and/or completely blocking gaseous hydrocarbon production from the hydrocarbon well.

Traditionally, plunger lift and/or rod pump systems have been utilized to provide artificial lift and to remove this wellbore liquid from the hydrocarbon well. While these systems may be effective under certain circumstances, they may not be capable of efficiently removing the wellbore liquid from long and/or deep hydrocarbon wells, from hydrocarbon wells that include one or more deviated (or nonlinear) portions (or regions), and/or from hydrocarbon wells in which the gaseous hydrocarbons do not generate at least a threshold pressure.

As an illustrative, non-exclusive example, plunger lift systems require that the gaseous hydrocarbons develop at least the threshold pressure to provide a motive force to convey a plunger between the subterranean formation and the surface region. As another illustrative, non-exclusive example, rod pump systems utilize a mechanical linkage (i.e., a rod) that extends between the surface region and the subterranean formation; and, as the depth of the well (or length of the mechanical linkage) is increased, the mechanical linkage becomes more prone to failure and/or more prone to damage the production tubing. However, plunger lift systems or rod pump systems may be unsuitable for use in wellbores that include deviated and/or nonlinear regions.

Improved hydrocarbon well drilling technologies permit an operator to drill a hydrocarbon well that extends for many thousands of meters within the subterranean formation, that has a vertical depth of hundreds, or even thousands, of meters, and/or that has a highly deviated wellbore. These improved drilling technologies are routinely utilized to drill long and/or deep hydrocarbon wells that permit production of gaseous hydrocarbons from previously inaccessible subterranean formations. However, a need exists for an efficient way to remove wellbore liquids from these hydrocarbon wells. Further, a need exists for a solution that avoids mechanical contacts and frictions on the wellbore liquid side.

SUMMARY

The disclosure includes a method of removing wellbore liquid from a wellbore that extends within a subterranean formation, comprising positioning a pump downhole in the wellbore, electrically powering the pump, expanding and contracting a membrane by pumping a fluid with the pump, wherein expanding and contracting the membrane creates a pressure for removing the wellbore liquid from the well, and removing the wellbore liquid from the well using the pressure.

The disclosure includes an apparatus for removing wellbore liquid from a wellbore that extends within a subterranean formation, comprising an electrical power inlet, an electric motor coupled to the electrical power inlet, a pump operatively coupled to the electric motor, and a membrane configured to expand and contract within the wellbore, wherein the membrane is further configured to provide a boundary between the wellbore liquid on one side and a hydraulic fluid for the pump on the other.

The disclosure includes a system for removing a wellbore liquid from a well, comprising a wellbore that extends between a surface region and a subterranean formation, a downhole pump located at a desired vertical distance from the surface region, wherein the downhole pump comprises a membrane configured to expand and contract within the wellbore, wherein the membrane is further configured to provide a boundary between the wellbore liquid on one side and a hydraulic fluid for the downhole pump on the other, and wherein the expansion and contraction of the membrane provides motive force to cause the wellbore liquid to move from downhole towards the surface region, at least one sensor coupled to the downhole pump and configured to detect a downhole parameter, a motor configured to drive the pump, and a motor controller configured to control the motor based at least in part on the downhole parameter detected by the at least one sensor.

DETAILED DESCRIPTION

In the following detailed description section, specific embodiments of the present techniques are described. However, to the extent that the following description is specific to a particular embodiment or a particular use of the present techniques, this is intended to be for exemplary purposes only and simply provides a description of the exemplary embodiments. Accordingly, the techniques are not limited to the specific embodiments described herein, but rather, include all alternatives, modifications, and equivalents falling within the true spirit and scope of the appended claims.

At the outset, for ease of reference, certain terms used in this application and their meanings as used in this context are set forth. To the extent a term used herein is not defined herein, it should be given the broadest definition persons in the pertinent art have given that term as reflected in at least one printed publication or issued patent. Further, the present techniques are not limited by the usage of the terms shown herein, as all equivalents, synonyms, new developments, and terms or techniques that serve the same or a similar purpose are considered to be within the scope of the present claims.

As used herein, the term "substantial" when used in reference to a quantity or amount of a material, or a specific characteristic thereof, refers to an amount that is sufficient to provide an effect that the material or characteristic was intended to provide. The exact degree of deviation allowable may depend, in some cases, on the specific context.

As used herein, the terms "a" and "an," mean one or more when applied to any feature in embodiments of the present inventions described in the specification and claims. The use of "a" and "an" does not limit the meaning to a single feature unless such a limit is specifically stated.

As used herein, the definite article "the" preceding singular or plural nouns or noun phrases denotes a particular specified feature or particular specified features and may have a singular or plural connotation depending upon the context in which it is used.

While the present techniques may be susceptible to various modifications and alternative forms, the exemplary embodiments discussed herein have been shown only by way of example. However, it should again be understood that the techniques disclosed herein are not intended to be limited to the particular embodiments disclosed. Indeed, the present techniques include all alternatives, modifications, combinations, permutations, and equivalents falling within the true spirit and scope of the appended claims.

Figure 1:
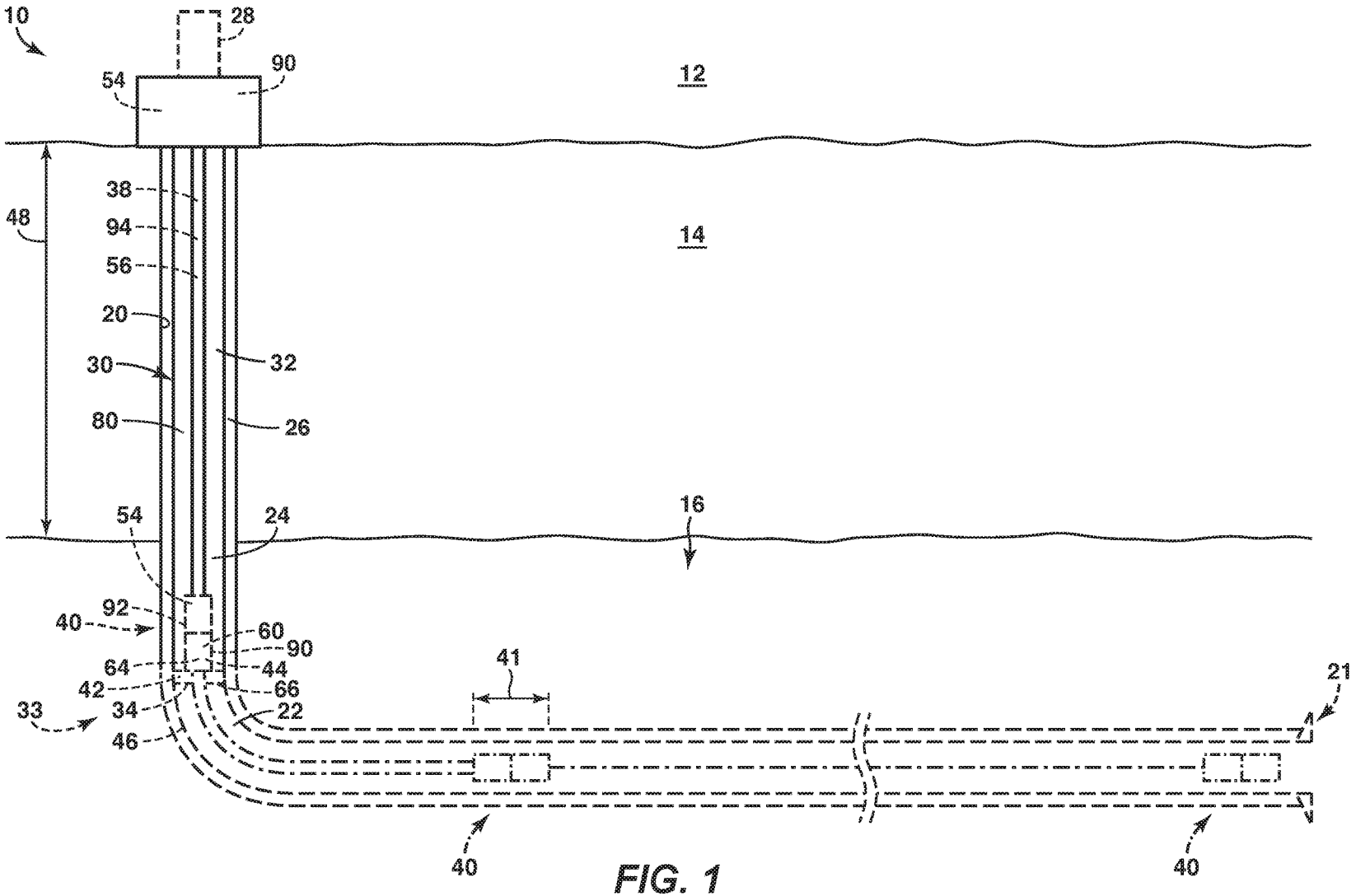
FIG. 1 is a schematic representation of a hydrocarbon well that may be utilized with and/or may include the systems and methods according to the present disclosure.

FIG. 1 is a schematic representation of illustrative, non-exclusive examples of a hydrocarbon well 10 that may be utilized with and/or include the systems and methods according to the present disclosure. Hydrocarbon well 10 includes a wellbore 20 that extends between a surface region 12 and a subterranean formation 16 that is present within a subsurface region 14. The hydrocarbon well further includes a tubing 30 that extends within the wellbore and defines a tubing conduit 32. Downhole pump 40 is located within the tubing conduit at least a threshold vertical distance 48 from surface region 12 (as illustrated in FIG. 1). Threshold vertical distance 48 additionally or alternatively may be referred to herein as threshold vertical depth 48. The downhole pump is configured to receive a wellbore liquid 22 and to pressurize the wellbore liquid to generate a pressurized wellbore liquid 24. A tubing 30 defines a liquid discharge conduit 80 that may extend between downhole pump 40 and surface region 12. The liquid discharge conduit is in fluid communication with tubing conduit 32 via downhole pump 40 and is configured to convey pressurized wellbore liquid 24 from the tubing conduit, such as to surface region 12.

As illustrated in dashed lines in FIG. 1, hydrocarbon well 10 may include a lubricator 28 that may be utilized to locate (i.e., insert and/or position) downhole pump 40 within tubing conduit 32 and/or to remove the downhole pump from the tubing conduit. In addition, and as illustrated in FIG. 1, an injection conduit 38 may extend between surface region 12 and downhole pump 40 and may be configured to inject a corrosion inhibitor and/or a scale inhibitor into tubing conduit 32 and/or into fluid contact with downhole pump 40, such as to decrease a potential for corrosion of and/or scale build-up within the downhole pump.

Figure 2:
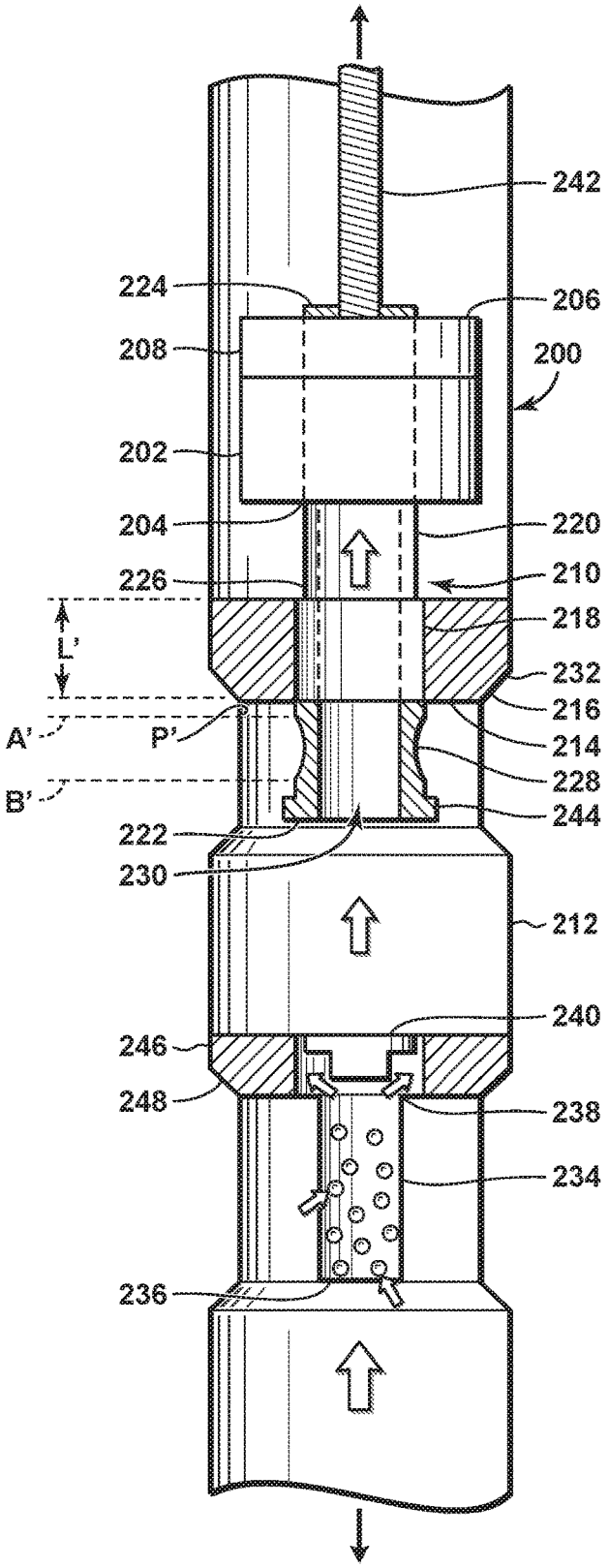
FIG. 2 is a schematic view of a system for removing fluids from a well.

As also illustrated in dashed lines, hydrocarbon well 10 and/or downhole pump 40 further may include a sand control structure 44, which may be configured to limit flow of sand into an inlet 66 of downhole pump 40, and/or a gas control structure 46, which may limit flow of a wellbore gas 26 (as illustrated in FIG. 1) into inlet 66 (as illustrated in FIG. 2) of downhole pump 40. As further illustrated in dashed lines in FIG. 1, tubing 30 may have a seat 34 attached thereto and/or included therein, with seat 34 being configured to receive downhole pump 40 and/or to retain downhole pump 40 at, or within, a desired region and/or location within tubing 30. Additionally or alternatively, downhole pump 40 may include and/or be operatively attached to a packer 42. Packer 42 may be configured to swell or otherwise be expanded within tubing conduit 32 and to thereby retain downhole pump 40 at, or within, the desired region and/or location within tubing 30.

The hydrocarbon well 10 and/or downhole pump 40 thereof further may include a power source 54 that is configured to provide an electric current to downhole pump 40. In addition, a sensor 92 may be configured to detect a downhole process parameter and may be located within wellbore 20, may be operatively attached to downhole pump 40, and/or may form a portion of the downhole pump. The sensor may be configured to convey a data signal that is indicative of the process parameter to surface region 12 and/or may be in communication with a controller 90 that is configured to control the operation of at least a portion of downhole pump 40.

As also discussed, downhole pump 40 may be powered by (or receive an electric current from) power source 54, which may be operatively coupled to the downhole pump, may form a portion of the downhole pump, and/or may be in electrical communication with the downhole pump via an electrical conduit 56. Illustrative, non-exclusive examples of electrical conduit 56 include any suitable wire, cable, wireline, and/or working line, and electrical conduit 56 may connect to downhole pump 40 via any suitable electrical connection and/or wet-mate connection. The electrical conduit 56 may serve as a deployment mechanism, a support mechanism, or both for the downhole pump 40. The power source 54 may itself receive power from various sources, e.g., a generator, an AC generator, a DC generator, a turbine, a solar-powered power source, a wind-powered power source, and/or a hydrocarbon-powered power source that may be located within surface region 12 and/or within wellbore 20. When power source 54 is located within wellbore 20, the power source also may be referred to herein as a downhole power generation assembly 54. In some embodiments, downhole pump 40 may alternately or additionally be configured to use an alternate power source, e.g., a battery pack, within the scope of this disclosure. Embodiments comprising a battery pack may locate the battery pack within surface region 12, may be located within wellbore 20, and/or may be operatively and/or directly attached to downhole pump 40.

Thus, downhole pump 40 according to the present disclosure may be configured to generate pressurized wellbore liquid 24 without utilizing a reciprocating mechanical linkage that extends between surface region 12 and the downhole pump (such as might be utilized with traditional rod pump systems) to provide a motive force for operation of the downhole pump. This may permit downhole pump 40 to be utilized in long, deep, and/or deviated wellbores where traditional rod pump systems may be ineffective, inefficient, and/or unable to generate the pressurized wellbore liquid 24.

The downhole pump may be configured to generate pressurized wellbore liquid 24 (and/or to remove the pressurized wellbore liquid from tubing conduit 32 via liquid discharge conduit 80) without requiring a threshold minimum pressure of wellbore gas 26. This may permit downhole pump 40 to be utilized in hydrocarbon wells 10 that do not develop sufficient gas pressure to permit utilization of traditional plunger lift systems and/or that define long and/or deviated tubing conduits 32 that preclude the efficient operation of traditional plunger lift systems.

The downhole pump 40 may operate as a positive displacement pump and thus may be sized, designed, and/or configured to generate pressurized wellbore liquid 24 at a pressure that is sufficient to permit a volume of the pressurized wellbore liquid to be conveyed via liquid discharge conduit 80 to surface region 12 without utilizing a large number of pumping stages. It follows that reducing the number of pumping stages may decrease a length 41 of the downhole pump (as illustrated in FIG. 1). As illustrative, non-exclusive examples, downhole pump 40 may include fewer than five stages, fewer than four stages, fewer than three stages, or a single stage. The downhole pump 40 may be a rotating pump, e.g., a gerotor pump, an internal gear pump, an external gear pump, a triple screw pump, an axial piston pump, a rotary vane pump, a radial piston pump, a centrifugal pump, etc. Downhole pump 40 may also be a reciprocating pump or a diaphragm/membrane pump.

As additional illustrative, non-exclusive examples, the downhole pump may have a length in a range from X to Y, wherein X is a value selected from 1 meter(s) (m), 2 m, 4 m, 6 m, 8 m, 10 m, 12 m, 14 m, 16 m, 18 m, 20 m, 22 m, 24 m, 26 m, or 28 m, and wherein Y is a value selected from 2 m, 4 m, 6 m, 8 m, 10 m, 12 m, 14 m, 16 m, 18 m, 20 m, 22 m, 24 m, 26 m, 28 m, or 30 m. Additionally or alternatively, the downhole pump may have an outer diameter in a range from X to Y, wherein X is a value selected from 1 cm, 3 cm, 5 cm, 6 cm, 7 cm, 8 cm, 9 cm, 10 cm, 12 cm, 14 cm, 16 cm, or 18 cm, and wherein Y is a value selected from, 3 cm, 5 cm, 6 cm, 7 cm, 8 cm, 9 cm, 10 cm, 12 cm, 14 cm, 16 cm, 18 cm, or 20 cm.

This (relatively) small length and/or (relatively) small diameter of downhole pumps 40 according to the present disclosure may permit the downhole pumps to be located within and/or to flow through and/or past deviated regions 33 within wellbore 20 and/or tubing conduit 32. The non-linear region 33 may include and/or be a tortuous region, a curvilinear region, an L-shaped region, an S-shaped region, and/or a transition region between a (substantially) horizontal region and a (substantially) vertical region that may define a tortuous trajectory, a curvilinear trajectory, a deviated trajectory, an L-shaped trajectory, an S-shaped trajectory, and/or a transitional, or changing, trajectory. These deviated regions might obstruct and/or retain longer and/or larger-diameter traditional pumping systems that do not include downhole pump 40 and/or that utilize a larger number (such as more than 5, more than 6, more than 8, more than 10, more than 15, or more than 20) of stages to generate pressurized wellbore liquid 24. Thus, downhole pumps 40 according to the present disclosure may be operable in hydrocarbon wells 10 that are otherwise inaccessible to more traditional artificial lift systems. This may include locating downhole pump 40 uphole from deviated regions 33, as schematically illustrated in dashed lines in FIG. 1, and/or locating downhole pump 40 downhole from deviated regions 33, such as in a horizontal portion of wellbore 20 and/or near a toe end 21 of wellbore 20 (as schematically illustrated in dash-dot lines in FIG. 1).

Additionally or alternatively, the (relatively) small length and/or the (relatively) small diameter of downhole pumps 40 according to the present disclosure may permit the downhole pumps to be located within tubing conduit 32 and/or removed from tubing conduit 32 via lubricator 28. This may permit the downhole pumps to be located within the tubing conduit without depressurizing hydrocarbon well 10, without killing well 10, without first supplying a kill weight fluid to wellbore 20, and/or while containing wellbore fluids within the wellbore. This may increase an overall efficiency of operations that insert downhole pumps into and/or remove downhole pumps from wellbore 20, may decrease a time required to permit downhole pumps 40 to be inserted into and/or removed from wellbore 20, and/or may decrease a potential for damage to hydrocarbon well 10 when downhole pumps 40 are inserted into and/or removed from wellbore 20.

Furthermore, and as discussed in more detail herein, downhole pumps 40 according to the present disclosure may be configured to generate pressurized wellbore liquid 24 at relatively low discharge flow rates and/or at selectively variable discharge flow rates. This may permit downhole pumps 40 to efficiently operate in low production rate hydrocarbon wells and/or in hydrocarbon wells that generate low volumes of wellbore liquid 22, in contrast to more traditional artificial lift systems.

Downhole pump 40 may include at least one membrane element 60 and a flow direction component 64. Membrane element 60 may be configured to selectively and/or repeatedly transition from an expanded state to a contracted state (and vice versa) during operation of the downhole pump 40, e.g., based on the position of the flow direction component 64. In alternate embodiments, transitioning the membrane element 60 from an expanded state to a contracted state (and vice versa) may include changing the operational direction of rotation for the downhole pump 40 and/or pump flow. The membrane element 60 may serve as a boundary between the wellbore liquid 24 on one side and a hydraulic fluid for the downhole pump 40 on the other.

Flow direction component 64 may be configured to direct a membrane expansion fluid, e.g., a substantially debris-free hydraulic fluid for the downhole pump 40, into and out of at least one membrane element 60. Using a substantially debris-free hydraulic fluid may additionally provide lubrication to the pump 40, e.g., by serving as a lubricating bath for the pump 40. Such a configuration may avoid having to use a rotating seal between the electric motor and the hydraulic pump, which seals may reduce the long-term reliability of the pumping unit. Suitable membrane expansion fluids include dielectric fluids that can lubricate the motor and/or pump, dissipate heat, that are shear and/or pressure resistant to breakdown, that reduce or eliminate foaming, that preserve membrane element material, etc.

Those of skill in the art will appreciate that alternate fluids may be suitably utilized within the scope of this disclosure.

The expansion of the membrane element 60 may pressurize the wellbore liquid 24. In some embodiments, the membrane element 60 is configured to expand primarily in a direction along the wellbore, while in other embodiments the membrane element 60 is configured to expand primarily in a direction across the diameter of the wellbore. The membrane element 60 may be configured to resist deformation by implosion. The membrane element 60 may be configured to ensure that no pockets of fluid are retained around the zone between the membrane element and its housing. Some embodiments of downhole pump 40 may include a plurality of membrane elements 60. Embodiments including a second membrane element 60 may be configured such that the second membrane element 60 expands during the contract cycle of the first membrane element 60, and wherein the second membrane element 60 contracts during the expand cycle of the first membrane element 60. For example, the flow direction component 64 may direct at least a portion of the membrane expansion fluid from the first membrane element 60 into the second membrane element 60 when the flow direction component 64 is in a first position and direct at least a portion of the membrane expansion fluid from the second membrane element 60 into the first membrane element 60 in a second position. In some embodiments, the flow direction component 64 can switch from the first position to the second position without changing either the speed or direction of the downhole pump 40. In some embodiments, the first membrane element 60 and the second membrane element 60 serve as a boundary between the wellbore liquid 24 on one side and a hydraulic fluid for the downhole pump 40 on the other.

As discussed in more detail herein, a discharge flow rate of pressurized wellbore liquid 24 that is generated by downhole pump 40 may be controlled, regulated, and/or varied by controlling, regulating, and/or varying a frequency of an AC electric current that is provided to downhole pump 40. This may include increasing the frequency of the AC electric current to increase the discharge flow rate (by decreasing a time that it takes for the downhole pump to transition between the expanded state and the contracted state) and/or decreasing the frequency of the AC or DC electric current to decrease the discharge flow rate (by increasing the time that it takes for the downhole pump to transition between the expanded state and the contracted state). Some embodiments may alternately or additionally utilize a variable speed drive (VSD) to vary the operational speed of the downhole pump 40. Alternately or additionally, some embodiments may vary pump displacement to obtain the desired discharge flow rate. All such changes in pump operating characteristics are considered within the scope of the present disclosure.

Controller 90 may include any suitable structure that may be configured to control the operation of any suitable portion of hydrocarbon well 10, such as downhole pump 40 and/or flow direction component 64. The controller 90 may be located in any suitable portion of hydrocarbon well 10. The controller 90 may include and/or be an autonomous and/or automatic controller and may be located in a suitable location, e.g., within wellbore 20, outside of wellbore 20 and operatively attached to downhole pump 40, etc. In some embodiments, the controller 90 may be configured to control the operation of downhole pump 40 without requiring that a data signal be conveyed to surface region 12 via data communication conduit 94. In some embodiments, the controller 90 may be located within surface region 12 and may be configured to communicate with downhole pump 40 via data communication conduit 94.

The controller 90 may be programmed to maintain a target wellbore liquid level within wellbore 20 above downhole pump 40. This may include increasing a discharge flow rate of pressurized wellbore liquid 24 that is generated by the downhole pump to decrease the wellbore liquid level and/or decreasing the discharge flow rate to increase the wellbore liquid level.

The controller 90 may be programmed to regulate the discharge flow rate to control the discharge pressure from the downhole pump 40 and/or to control the volumetric throughput from the downhole pump 40. This may include increasing the discharge flow rate to increase the discharge pressure or volumetric throughput, and/or decreasing the discharge flow rate to decrease the discharge pressure or volumetric throughput, as appropriate.

A sensor 92 may be coupled to the downhole pump 40. The sensor 92 may include any suitable structure that is configured to detect the downhole parameter, e.g., a downhole temperature, a downhole pressure, component/system vibration, a discharge pressure from the downhole pump, a downhole flow rate, a volumetric throughput of the downhole pump, and/or a discharge flow rate from the downhole pump. The sensor 92 may be configured to detect the downhole parameter at any suitable location within wellbore 20. As an illustrative, non-exclusive example, the sensor may be located such that the downhole parameter is indicative of a condition at an inlet to downhole pump 40. The sensor 92 may be located such that the downhole parameter is indicative of a condition at an outlet from downhole pump 40.

When hydrocarbon well 10 includes sensor 92, the hydrocarbon well 10 may include a data communication conduit 94 configured to convey a signal indicative of the downhole parameter between sensor 92 and surface region 12. The data communication conduit 94 may convey the signal to the controller 90 when the controller 90 is located within surface region 12. The data communication conduit 94 may alternately or additionally convey the signal to a display and/or to a terminal located at surface region 12.

As discussed, downhole pump 40 according to the present disclosure may be utilized to provide artificial lift in wellbores that define a large vertical distance, or depth, 48, in wellbores that define a large overall length, and/or in wellbores in which downhole pump 40 is located at least a threshold vertical distance from surface region 12. For example, the vertical depth of wellbore 20, the overall length of wellbore 20, and/or the threshold vertical distance of downhole pump 40 from surface region 12 may be a value in a range from X to Y, wherein X is selected from 250 m, 500 m, 750 m, 1000 m, 1250 m, 1500 m, 1750 m, 2000 m, 2250 m, 2500 m, 2750 m, 3000 m, and 3250 m, and wherein Y is selected from 500 m, 750 m, 1000 m, 1250 m, 1500 m, 1750 m, 2000 m, 2250 m, 2500 m, 2750 m, 3000 m, and 3250 m, and 3500 m. Additionally or alternatively, the vertical depth of wellbore 20, the overall length of wellbore 20, and/or the threshold vertical distance of downhole pump 40 from surface region 12 may be a value in a range between X and Y, wherein X is selected from 8000 m, 7750 m, 7500 m, 7250 m, 7000 m, 6750 m, 6500 m, 6250 m, 6000 m, 5750 m, 5500 m, 5250 m, 5000 m, 4750 m, 4500 m, and 4250 m, and wherein Y is selected from 7750 m, 7500 m, 7250 m, 7000 m, 6750 m, 6500 m, 6250 m, 6000 m, 5750 m, 5500 m, 5250 m, 5000 m, 4750 m, 4500 m, 4250 m, 4000 m. Further additionally or alternatively, the vertical depth of wellbore 20, the overall length of wellbore 20, and/or the threshold vertical distance of downhole pump 40 from surface region 12 may be in a range defined, or bounded, by any combination of the preceding maximum and minimum depths.

FIG. 2 is a schematic view of a system for 200 removing fluids from a well, according to the present disclosure is presented. The components of FIG. 2 may be substantially the same as the corresponding components of the prior figures except as otherwise noted. The system 200 includes a pump 202, e.g., the downhole pump 40 of FIG. 1, having an inlet end 204 and a discharge end 206. A motor 208 is operatively connected to the pump 202 for driving the pump 202.

The system 200 includes an apparatus 210 for reducing the force required to pull the pump 202 from a tubular 212. As shown, the apparatus 210 may be positioned upstream of the pump 202. Apparatus 210 includes a tubular sealing device 214 for mating with a downhole tubular component 216, the tubular sealing device 214 having an axial length L' and a longitudinal bore 218 there through.

Apparatus 210 also includes an elongated rod 220, slidably positionable within the longitudinal bore 218 of the tubular sealing device 214. The elongated rod 220 includes a first end 222, a second end 224, and an outer surface 226. As shown in FIG. 2, the outer surface 226 is structured and arranged to provide a hydraulic seal when the elongated rod is in a first position (when position A' is aligned with point P') within the longitudinal bore 218 of the tubular sealing device 214. Also, as shown in FIG. 2, the outer surface 226 of elongated rod 220 is structured and arranged to provide at least one external flow port 228 for pressure equalization upstream and downstream of the tubular sealing device 214 when the elongated rod 220 is placed in a second position (when position B' is aligned with point P') within the longitudinal bore 218 of the tubular sealing device 214.

In some embodiments, the elongated rod 220 includes an axial flow passage 230 extending there through, the axial flow passage in fluid communication with the pump 202.

In some embodiments, the tubular sealing device 214 is structured and arranged for landing within a nipple profile (not shown) or for attaching to a collar stop 232 for landing directly within the tubular 212.

In some embodiments, a well screen or filter 234 is provided, the well screen or filter 234 in fluid communication with the inlet end 204 of the pump 202, the well screen or filter 234 having an inlet end 236 and an outlet end 238.

In some embodiments, a velocity fuse or standing valve 240 is positioned between the outlet end 238 of the well screen or filter 234 and the first end 222 of the elongated rod 220. As shown, the velocity fuse 240 is in fluid communication with the well screen or filter 234.

In some embodiments, the velocity fuse 240 is structured and arranged to back-flush the well screen or filter 234 and maintain a column of fluid within the tubular 212 in response to an increase in pressure drop across the velocity fuse 240. In some embodiments, the velocity fuse 240 is normally open and comprises a spring-loaded piston responsive to changes in pressure drop across the velocity fuse 240.

In some embodiments, the apparatus 210 is structured and arranged to be installed and retrieved from the tubular 212 by a wireline or coiled tubing 242. In some embodiments, the apparatus 210 is integral to the tubing string.

In some embodiments, the first end 222 of the elongated rod 220 includes an extension 244 for applying a jarring force to the tubular sealing device 214 to assist in the removal thereof.

In some embodiments, the velocity fuse 240 may be installed within a housing 246. In some embodiments, the housing 246 is structured and arranged for sealably engaging the tubular 212. In some embodiments, the housing 246 comprises at least one seal 248. In some embodiments, the housing 246 may be configured to seat within a tubular 212, as shown.

Figure 3:
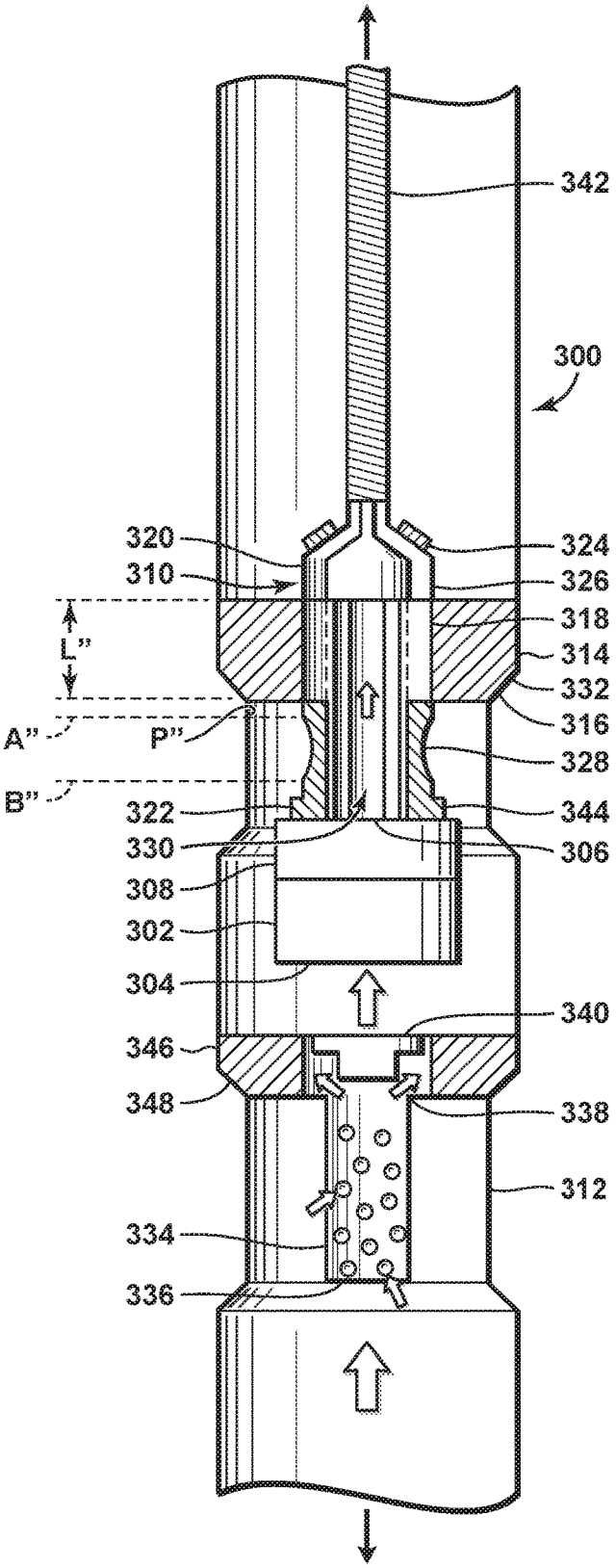
FIG. 3 is a schematic view of a system for removing fluids from a well.

FIG. 3 is a schematic view of a system 300 for removing fluids from a well, according to the present disclosure. The components of FIG. 3 may be substantially the same as the corresponding components of the prior figures except as otherwise noted. The system 300 includes a pump 302, e.g., the downhole pump 40 of FIG. 1, having an inlet end 304 and a discharge end 306. A motor 308 is operatively connected to the pump 302 for driving the pump 302.

The system 300 also includes an apparatus 310 for reducing the force required to pull the pump 302 from a tubular 312. As shown, the apparatus 310 may be positioned downstream of the pump 302. Apparatus 310 includes a tubular sealing device 314 for mating with a downhole tubular component 316, the tubular sealing device 314 having an axial length L" and an longitudinal bore 318 there through.

Apparatus 310 also includes an elongated rod 320, slidably positionable within the longitudinal bore 318 of the tubular sealing device 314. The elongated rod 320 includes a first end 322, a second end 324, and an outer surface 326. As shown in FIG. 3, the outer surface 326 is structured and arranged to provide a hydraulic seal when the elongated rod is in a first position (when position A" is aligned with point P") within the longitudinal bore 318 of the tubular sealing device 314. Also, as shown in FIG. 3, the outer surface 326 of elongated rod 320 is structured and arranged to provide at least one external flow port 328 for pressure equalization upstream and downstream of the tubular sealing device 314 when the elongated rod 320 is placed in a second position (when position B" is aligned with point P") within the longitudinal bore 318 of the tubular sealing device 314.

In some embodiments, the elongated rod 320 includes an axial flow passage 330 extending there through, the axial flow passage in fluid communication with the pump 302.

In some embodiments, the tubular sealing device 314 is structured and arranged for landing within a nipple profile (not shown) or for attaching to a collar stop 332 for landing directly within the tubular 312.

In some embodiments, a well screen or filter 334 is provided, the well screen or filter 334 in fluid communication with the inlet end 304 of the pump 302, the well screen or filter 334 having an inlet end 336 and an outlet end 338.

In some embodiments, a velocity fuse or standing valve 340 is positioned between the outlet end 338 of the well screen or filter 334 and the first end 322 of the elongated rod 320. As shown, the velocity fuse 340 is in fluid communication with the well screen or filter 334.

In some embodiments, the velocity fuse 340 is structured and arranged to back-flush the well screen or filter 334 and maintain a column of fluid within the tubular 312 in response to an increase in pressure drop across the velocity fuse 340. As will be described below, with reference to FIG. 3. In some embodiments, the velocity fuse 340 is normally open and comprises a spring-loaded piston responsive to changes in pressure drop across the velocity fuse 340.

In some embodiments, the apparatus 310 is structured and arranged to be installed and retrieved from the tubular 312 by a wireline or coiled tubing 342. In some embodiments, the apparatus 310 is integral to the tubing string.

In some embodiments, the first end 322 of the elongated rod 320 includes an extension 344 for applying a jarring force to the tubular sealing device 314 to assist in the removal thereof.

In some embodiments, the velocity fuse 340 may be installed within a housing 346. In some embodiments, the housing 346 is structured and arranged for sealably engaging the tubular 312. In some embodiments, the housing 346 comprises at least one seal 348. In some embodiments, the housing 346 may be configured to seat within a tubular 312, as shown.

Figure 4:
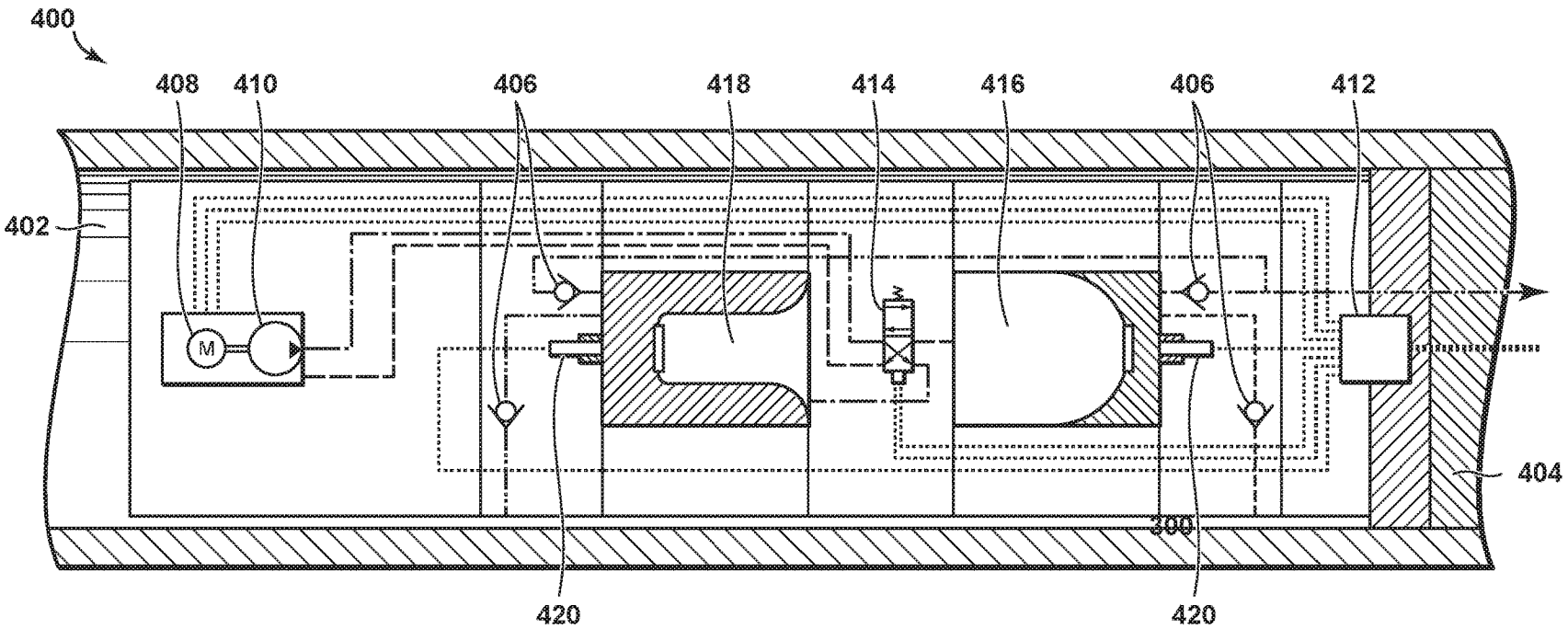
FIG. 4 is a schematic cross-sectional diagram of an embodiment of a downhole pump.

FIG. 4 is a schematic cross-sectional diagram of an embodiment of a downhole pump 400, e.g., the downhole pump 40 of FIG. 1. The components of FIG. 4 may be may be substantially the same as the corresponding components of the prior figures except as otherwise noted. The downhole pump 400 includes a fluid intake 402, e.g., on an inlet end 204 of FIG. 2, configured to receive wellbore liquid from upstream and a fluid discharge 404, e.g., on a discharge end 206 of FIG. 2, configured to pass wellbore liquid downstream. Check valves 406 are positioned at optionally selected locations between the fluid intake 402 and the fluid discharge 404 to prevent backflow.

The downhole pump 400 comprises a motor 408, e.g., an alternating current (AC) induction motor, a permanent magnet motor, a brushed direct current (DC) motor, a brushless DC motor, etc. The motor 402 may be substantially the same as the motor 208 of FIG. 2.

The motor 402 is operatively coupled to a micro pump 410, e.g., an axial piston pump. The micro pump 410 is configured to pump a membrane expansion fluid, e.g., a substantially debris-free hydraulic fluid.

A motor controller 412, e.g., the controller 90 of FIG. 1, is operatively coupled to the motor 408, e.g., using a VSD. The motor controller 412 may control the speed of the motor 402 in response to a sensed downhole parameter, e.g., as sensed by a sensor 92 of FIG. 1. The motor controller 412 is operatively coupled to and/or configured to switch a valve 414, e.g., a four-way electronic switching valve, configured to direct a membrane expansion fluid from a first membrane element 416 into a second membrane element 418 in a first position and from the second membrane element 418 into the first membrane element 416 in a second position. Some embodiments may include one or more hydraulic shock absorber devices to dampen the passage of hydraulic fluid from the first membrane element 416 into the second membrane element 418. Using a configuration as shown and described enables switching the valve 414 from the first position to the second position without changing the direction of the pump.

End of stroke sensors 420 are positioned so as to sense the end of an expansion stroke of an associated membrane element 416, 418. The end of stroke sensors 420 are coupled to the motor controller 412 and may be used to control the switching of the valve 414 and, therefore, the expansion and contraction cycles of the membrane elements 416, 418. The membrane elements 416, 418 may be configured to function as a boundary between the wellbore liquid on one side and the micro pump 410 and/or membrane expansion fluid on the other. This may help reduce or prevent oxidation, binding, fouling, clogging, or otherwise adversely affecting the operation of the micro pump 410. Alternate embodiments may not require the boundary and may include one or more filters to keep particulate and/or debris out of the micro pump 410. Still other embodiments use one or more filters in conjunction with the boundary of membrane elements 416, 418, e.g., internal to the boundary for filtering the membrane expansion fluid, external to the boundary for filtering one or more wellbore fluids, or both.

While depicted with two membrane elements 416, 418, those of skill in the art will appreciate that more or fewer membrane elements may be utilized within the scope of this embodiment. For example, some embodiments may comprise a plurality of opposing membrane elements may be disposed circumferentially. Other embodiments may comprise a single membrane element in combination with a membrane expansion fluid reservoir, e.g., a piston, a cavity, etc. Some embodiments may comprise one or more membrane elements configured to expand primarily in a direction along the wellbore, some embodiments may comprise one or more membrane elements expand primarily in a direction across the diameter of the wellbore, and some embodiments may comprise combinations thereof.

Figure 5:
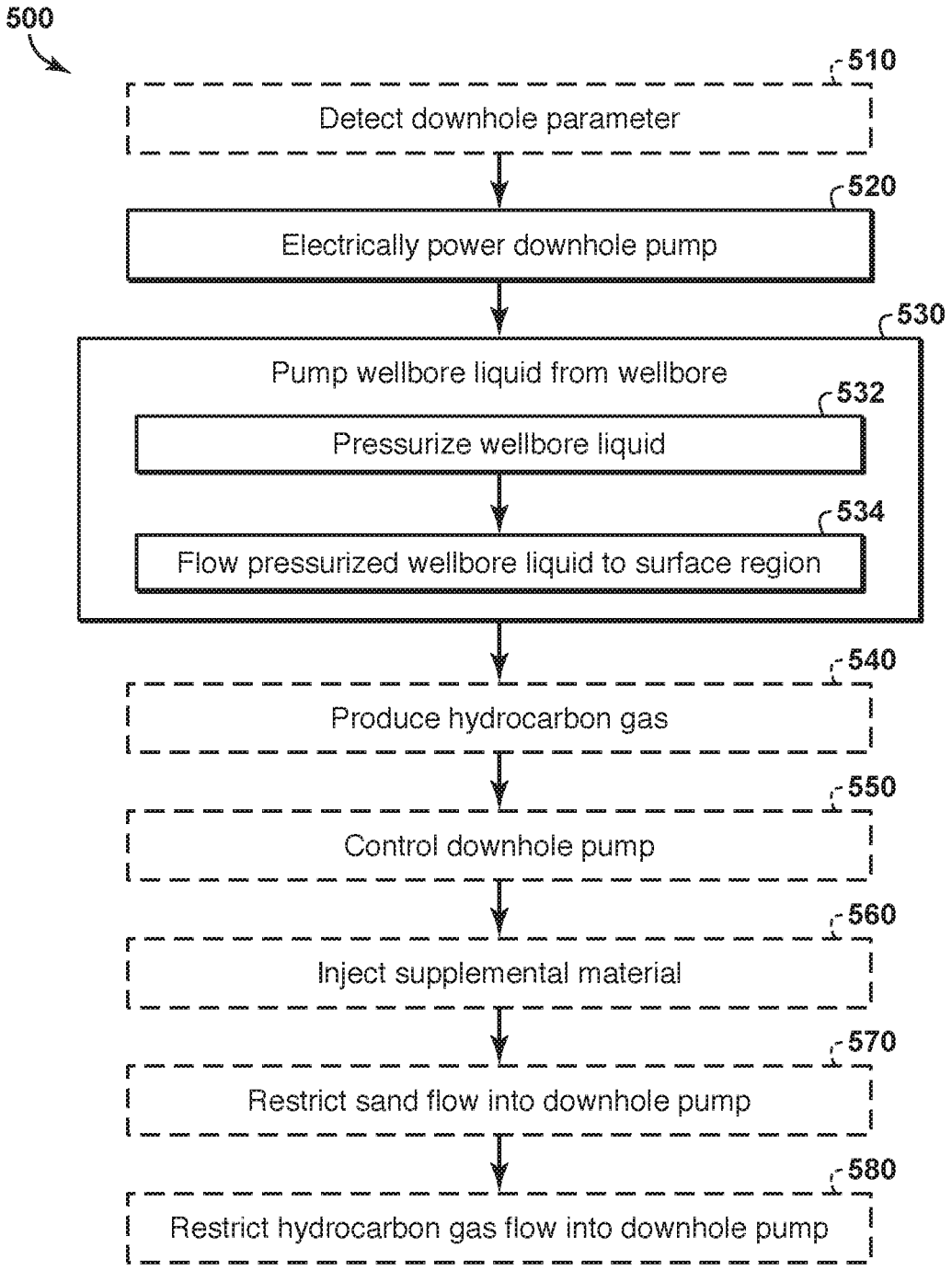
FIG. 5 is a flowchart depicting a method according to the present disclosure of removing a wellbore liquid from a wellbore.

FIG. 5 is a flowchart depicting a method 500 according to the present disclosure of removing a wellbore liquid from a wellbore, e.g., the wellbore 20 of FIG. 1, that extends within a subterranean formation, e.g., the subterranean formation 16 of FIG. 1. The method 500 may include detecting a downhole parameter at 510, e.g., using a sensor 92 of FIG. 1, and include electrically powering a downhole pump at 520, e.g., the downhole pump 40 of FIG. 1, and pumping the wellbore liquid from the wellbore at 530. The method 500 further may include producing a hydrocarbon gas at 540, controlling the operation of a downhole pump at 550, injecting a supplemental material into the wellbore at 560, restricting sand flow into the downhole pump at 570, and/or restricting hydrocarbon gas flow into the downhole pump at 580.

Detecting the downhole parameter at 510 may include detecting any suitable downhole parameter that is indicative of any suitable condition within the wellbore. As illustrative, non-exclusive examples, the downhole process parameter may be collected at, or near, an inlet to the downhole pump, may be indicative of a condition at, or near, the inlet to the downhole pump, may be collected at, or near, an outlet from the downhole pump, and/or may be indicative of a condition at, or near, the outlet from the downhole pump. Illustrative, non-exclusive examples of the downhole parameter are discussed herein. When the method 500 includes the detecting at 510, the method 500 may further include communicating the downhole process parameter to a surface region and/or utilizing the downhole parameter to control the operation of the downhole pump.

Electrically powering the downhole pump at 520 may include electrically powering the downhole pump with any suitable electric current that may be provided to the downhole pump and/or generated in any suitable manner. As an illustrative, non-exclusive example, the electrically powering at 520 may include conveying an electric current from the surface region to the downhole pump, such as via an electrical conduit, and providing the electric current to the downhole pump. Additionally or alternatively, the electrically powering at 520 also may include generating the electric current within the wellbore and conveying the electric current to the downhole pump. Illustrative, non-exclusive examples of the electrical conduit and/or the electric current are discussed in more detail herein.

Pumping the wellbore liquid from the wellbore at 530 may include pumping the wellbore liquid from the wellbore with the downhole pump. This may include pressurizing, at 532, the wellbore liquid within the downhole pump to generate a pressurized wellbore liquid at a discharge pressure and/or flowing, at 534, the pressurized wellbore liquid at least a threshold vertical distance to the surface region at a discharge flow rate. Thus, the pumping may include pushing the wellbore liquid at least a threshold distance towards a surface region, e.g., by expanding and/or contracting one or more membrane elements (discussed below).

The pumping at 530 may include at least substantially continuously pumping the wellbore liquid from the wellbore and/or pumping the pressurized wellbore liquid through a liquid discharge conduit that extends within the wellbore and/or between the downhole pump and the surface region. Illustrative, non-exclusive examples of the discharge pressure include discharge pressures of at least 20 megapascals (MPa), at least 25 MPa, at least 30 MPa, at least 35 MPa, at least 40 MPa, at least 45 MPa, at least 50 MPa, at least 55 MPa, at least 60 MPa, at least 65 MPa, and/or at least 70 MPa. Additionally or alternatively, the discharge pressure also may be less than 100 MPa, less than 95 MPa, less than 80 MPa, less than 75 MPa, less than 70 MPa, less than 65 MPa, less than 60 MPa, less than 55 MPa, and/or less than 50 MPa. Further additionally or alternatively, the discharge pressure may be in a range bounded by any combination of the preceding minimum and maximum discharge pressures. Pumps may be optionally selected based at least in part on the desired discharge pressure characteristics.

The discharge pressure (in kilopascals) also may be at least a threshold multiple of the threshold vertical distance (in meters). Illustrative, non-exclusive examples of the threshold multiple include threshold multiples of at least 5, at least 6, at least 7, at least 8, at least 9, at least 10, at least 11, and/or at least 12.

Illustrative, non-exclusive examples of the discharge flow rate include discharge flow rates of at least 0.5, at least 0.75, at least 1, at least 2, at least 3, at least 4, at least 5, at least 6, at least 7, at least 8, at least 9, at least 10, at least 12, at least 14, at least 16, at least 18, at least 20, at least 22, at least 24, at least 26, at least 28, and/or at least 30 cubic meters per day. Additionally or alternatively, the discharge flow rate also may be less than 40, less than 38, less than 36, less than 34, less than 32, less than 30, less than 28, less than 26, less than 24, less than 22, less than 20, less than 18, less than 16, less than 14, less than 12, less than 10, less than 9, less than 8, less than 7, less than 6, less than 5, less than 4, less than 3, less than 2, and/or less than 1 cubic meters per day. Further additionally or alternatively, the discharge flow rate may be a range bounded by any combination of the preceding minimum and maximum discharge flow rates.

The pumping at 530 further may include pumping with at least a threshold pumping efficiency. Illustrative, non-exclusive examples of the threshold pumping efficiency include threshold pumping efficiencies of at least 50%, at least 55%, at least 60%, at least 65%, at least 70%, at least 75%, and/or at least 80%.

As a more specific but still illustrative, non-exclusive example, the downhole pump may include a membrane element, e.g., the membrane element 60 of FIG. 1, and the pumping at 530 may include repeatedly transitioning the membrane element from an expanded state to a contracted state (and vice versa) in order to create a pressure for removing the wellbore liquid from the well. The downhole pump further may include a flow direction component for directing a membrane expansion fluid into and out of the membrane element while continuously operating the pump in a single direction.

The pumping at 530 also may include selectively permitting, restricting, or resisting flow of the pressurized wellbore liquid into the wellbore. This may include selectively permitting and/or selectively resisting with an inlet check valve. Additionally or alternatively, the pumping at 530 also may include selectively permitting flow of the pressurized wellbore liquid into a liquid discharge conduit and also selectively restricting, or resisting, flow of the pressurized wellbore liquid from the liquid discharge conduit. This may include selectively permitting and/or selectively resisting with an outlet check valve.

It is within the scope of the present disclosure that the pumping at 530 further may include removing a volume of the pressurized wellbore liquid from the well using the expansion and/or contraction of the membrane element disposed on the downhole pump. As illustrative, non-exclusive examples, the emitting may include emitting at least 5 cubic centimeters, at least 10 cubic centimeters, at least 20 cubic centimeters, at least 30 cubic centimeters, at least 40 cubic centimeters, at least 50 cubic centimeters, at least 60 cubic centimeters, at least 70 cubic centimeters, at least 80 cubic centimeters, at least 90 cubic centimeters, and/or at least 100 cubic centimeters of the pressurized wellbore liquid during the (or during each) membrane expansion stroke. Additionally or alternatively, the removing also may include removing less than 400 cubic centimeters, less than 350 cubic centimeters, less than 300 cubic centimeters, less than 250 cubic centimeters, less than 200 cubic centimeters, less than 180 cubic centimeters, less than 160 cubic centimeters, less than 140 cubic centimeters, less than 120 cubic centimeters, and/or less than 100 cubic centimeters of the pressurized wellbore liquid during the (or during each) membrane expansion stroke. Further additionally or alternatively, the removing may include removing pressurized wellbore liquid in a range bounded by any of the preceding minimum and maximum volumes during the (or during each) membrane expansion stroke.

Producing the hydrocarbon gas at 540 may include producing the hydrocarbon gas from the subterranean formation and may be performed at least partially concurrently with the pumping at 530. As an illustrative, non-exclusive example, the producing at 540 may include producing through a gas discharge conduit that extends within the wellbore and/or between the subterranean formation and the surface region.

Controlling the operation of the downhole pump at 550 may include controlling the operation of any suitable portion of the downhole pump, and it is within the scope of the present disclosure that the controlling at 550 may be accomplished in any suitable manner. As illustrative, non-exclusive examples, the controlling at 550 may include automatically controlling, autonomously controlling, controlling with a controller, e.g., the controller 90 of FIG. 1, that is located within the wellbore, controlling with a controller, e.g., the controller 90 of FIG. 1, that is directly attached to the downhole pump, and/or controlling without requiring that a data signal be conveyed between the downhole pump and the surface region.

As illustrative, non-exclusive examples, the controlling at 550 may include controlling the discharge flow rate and/or the discharge pressure from the downhole pump, e.g., using a VSD. As another illustrative, non-exclusive example, and as discussed herein, the controlling at 550 also may include regulating a frequency of an AC electric current that is provided to the downhole pump during the electrically powering at 520. Additionally or alternatively, controlling at 550 may include varying pump displacement and/or stroke length.

As a more specific but still illustrative, non-exclusive example, the controlling at 550 also may include maintaining a target wellbore liquid level within the wellbore above the downhole pump (or an inlet thereof), such as to prevent (or decrease a potential for) a gas lock condition within the downhole pump. As another more specific but still illustrative, non-exclusive example, the detecting at 510 may include monitoring the discharge pressure from the downhole pump, and the controlling at 550 may include regulating the discharge flow rate to control the discharge pressure. This may include increasing the discharge flow rate to increase the discharge pressure and/or decreasing the discharge flow rate to decrease the discharge pressure.

As yet another more specific but still illustrative, non-exclusive example, the downhole pump may include a liquid inlet valve that is configured to selectively introduce the wellbore liquid into the compression chamber of the downhole pump. Under these conditions, the detecting at 510 may include detecting a gas lock condition of the downhole pump, and the controlling at 550 may include opening the liquid inlet valve responsive to detecting the gas lock condition.

Injecting the supplemental material into the wellbore at 560 may include injecting any suitable supplemental material into any suitable portion of the wellbore. As an illustrative, non-exclusive example, the injecting at 560 may include injecting a corrosion inhibitor and/or a scale inhibitor into the wellbore, such as to decrease a potential for corrosion of and/or scale buildup within the downhole pump and/or to increase a service life of the downhole pump. As another illustrative, non-exclusive example, the injecting at 560 also may include injecting downhole from the downhole pump, injecting into the downhole pump, and/or injecting such that the supplemental material flows through the downhole pump with the wellbore liquid.

Restricting sand flow into the downhole pump at 570 may include restricting using any suitable structure. As an illustrative, non-exclusive example, the restricting at 570 may include restricting with a sand filter. Similarly, restricting hydrocarbon gas flow into the downhole pump at 580 may include restricting using any suitable structure. As an illustrative, non-exclusive example, the restricting at 580 may include restricting with a gas-liquid separation assembly that is located upstream from, that is operatively attached to, and/or that forms a portion of the downhole pump.

Figure 6:
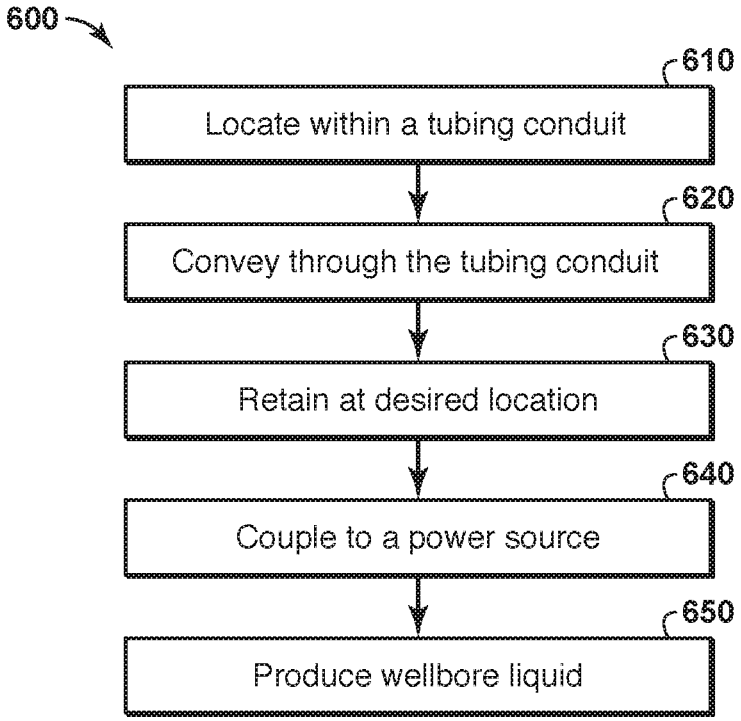
FIG. 6 is a flowchart depicting a method according to the present disclosure of locating a downhole pump.

FIG. 6 is a flowchart depicting a method 600 according to the present disclosure of locating a downhole pump, e.g., the downhole pump 40 of FIG. 1, within a wellbore, e.g., the wellbore 20 of FIG. 1, that extends within a subterranean formation, e.g., the subterranean formation 16 of FIG. 1. The method 600 includes locating the downhole pump within a tubing conduit at 610 and conveying the downhole pump through the tubing conduit at 620. The method 600 may include retaining the downhole pump at a desired location within the tubing conduit at 630, coupling the downhole pump with a power source at 640, and/or producing a wellbore liquid from the wellbore at 650.

Locating the downhole pump within the tubing conduit at 610 may include locating the downhole pump in any suitable tubing conduit that may be defined by a tubing that extends within the wellbore. As an illustrative, non-exclusive example, the locating at 610 may include placing the downhole pump within a lubricator that is in selective fluid communication with the tubing conduit and/or transferring the downhole pump from the lubricator to the tubing conduit. As another illustrative, non-exclusive example, the locating at 610 also may include locating without first killing a hydrocarbon well that includes the wellbore, locating without supplying a kill weight fluid to the wellbore, locating while containing (all) wellbore fluids within the wellbore, and/or locating without depressurizing (or completely depressurizing) the wellbore (or at least a portion of the wellbore that is proximal to the surface region).

Conveying the downhole pump through the tubing conduit at 620 may include conveying until the downhole pump is at least a threshold vertical distance from the surface region. Illustrative, non-exclusive examples of the threshold vertical distance are disclosed herein.

It is within the scope of the present disclosure that the tubing conduit may define a nonlinear trajectory and/or a nonlinear region and that the conveying at 620 may include conveying along the nonlinear trajectory, through the nonlinear region, and/or past the nonlinear region. Illustrative, non-exclusive examples of the nonlinear region and/or the nonlinear trajectory are discussed herein.

The conveying may be accomplished in any suitable manner. As an illustrative, non-exclusive example, the conveying may include establishing a fluid flow from the surface region, through the tubing conduit, and into the subterranean formation; and the conveying at 620 may include flowing the downhole pump through the tubing conduit with the fluid flow. As additional illustrative, non-exclusive examples, the conveying at 620 also may include conveying on a wireline, conveying with coiled tubing, conveying with rods, etc.

Retaining the downhole pump at the desired location within the tubing conduit at 630 may include retaining the downhole pump in any suitable manner. As an illustrative, non-exclusive example, the retaining at 630 may include swelling a packer that is operatively attached to the downhole pump to retain the downhole pump at the desired location. As another illustrative, non-exclusive example, the retaining at 630 also may include locating the downhole pump on a seat that is present within the tubing conduit and that is configured to receive and/or to retain the downhole pump.

Coupling the downhole pump with the power source at 640 may include coupling the downhole pump with the power source subsequent to the conveying at 620. Illustrative, non-exclusive examples of the power source are disclosed herein.

Producing the wellbore liquid from the wellbore at 650 may include producing the wellbore liquid with the downhole pump and may be accomplished in any suitable manner. As an illustrative, non-exclusive example, the producing at 650 may be at least substantially similar to the pumping at 630, which is discussed in more detail herein.

In the present disclosure, several of the illustrative, non-exclusive examples have been discussed and/or presented in the context of flow diagrams, or flow charts, in which the methods are shown and described as a series of blocks, or steps. Unless specifically set forth in the accompanying description, it is within the scope of the present disclosure that the order of the blocks may vary from the illustrated order in the flow diagram, including with two or more of the blocks (or steps) occurring in a different order and/or concurrently. It is also within the scope of the present disclosure that the blocks, or steps, may be implemented as logic, which also may be described as implementing the blocks, or steps, as logics. In some applications, the blocks, or steps, may represent expressions and/or actions to be performed by functionally equivalent circuits or other logic devices. The illustrated blocks may, but are not required to, represent executable instructions that cause a computer, processor, and/or other logic device to respond, to perform an action, to change states, to generate an output or display, and/or to make decisions.

As used herein, the term "and/or" placed between a first entity and a second entity means one of (1) the first entity, (2) the second entity, and (3) the first entity and the second entity. Multiple entities listed with "and/or" should be construed in the same manner, i.e., "one or more" of the entities so conjoined. Other entities may optionally be present other than the entities specifically identified by the "and/or" clause, whether related or unrelated to those entities specifically identified. Thus, as a non-limiting example, a reference to "A and/or B," when used in conjunction with open-ended language such as "comprising" may refer, in one embodiment, to A only (optionally including entities other than B); in another embodiment, to B only (optionally including entities other than A); in yet another embodiment, to both A and B (optionally including other entities). These entities may refer to elements, actions, structures, steps, operations, values, and the like.

As used herein, the phrase "at least one," in reference to a list of one or more entities should be understood to mean at least one entity selected from any one or more of the entity in the list of entities, but not necessarily including at least one of each and every entity specifically listed within the list of entities and not excluding any combinations of entities in the list of entities. This definition also allows that entities may optionally be present other than the entities specifically identified within the list of entities to which the phrase "at least one" refers, whether related or unrelated to those entities specifically identified. Thus, as a non-limiting example, "at least one of A and B" (or, equivalently, "at least one of A or B," or, equivalently "at least one of A and/or B") may refer, in one embodiment, to at least one, optionally including more than one, A, with no B present (and optionally including entities other than B); in another embodiment, to at least one, optionally including more than one, B, with no A present (and optionally including entities other than A); in yet another embodiment, to at least one, optionally including more than one, A, and at least one, optionally including more than one, B (and optionally including other entities). In other words, the phrases "at least one," "one or more," and "and/or" are open-ended expressions that are both conjunctive and disjunctive in operation. For example, each of the expressions "at least one of A, B and C," "at least one of A, B, or C," "one or more of A, B, and C," "one or more of A, B, or C" and "A, B, and/or C" may mean A alone, B alone, C alone, A and B together, A and C together, B and C together, A, B and C together, and optionally any of the above in combination with at least one other entity.

In the event that any patents, patent applications, or other references are incorporated by reference herein and (1) define a term in a manner that is inconsistent with and/or (2) are otherwise inconsistent with, either the non-incorporated portion of the present disclosure or any of the other incorporated references, the non-incorporated portion of the present disclosure shall control, and the term or incorporated disclosure therein shall only control with respect to the reference in which the term is defined and/or the incorporated disclosure was present originally.

As used herein the terms "adapted" and "configured" mean that the element, component, or other subject matter is designed and/or intended to perform a given function. Thus, the use of the terms "adapted" and "configured" should not be construed to mean that a given element, component, or other subject matter is simply "capable of" performing a given function but that the element, component, and/or other subject matter is specifically selected, created, implemented, utilized, programmed, and/or designed for the purpose of performing the function. It is also within the scope of the present disclosure that elements, components, and/or other recited subject matter that is recited as being adapted to perform a particular function may additionally or alternatively be described as being configured to perform that function, and vice versa.

What is claimed is:

1. A method of removing wellbore liquid from a wellbore that extends within a subterranean formation, comprising:

positioning a hydraulic pump within a wellbore tubing downhole in the wellbore using an electric power cable, the pump being a membrane pump including an intake and a discharge, the pump being removable from the wellbore using the electric power cable;

electrically powering a motor for powering the pump;

positioning the motor downhole in the wellbore with the pump using the electric cable;

seating the pump within the wellbore tubing downhole in the wellbore creating a hydraulic seal between the pump discharge and the pump intake;

expanding and contracting a first membrane by pumping a fluid with the pump, wherein expanding and contracting the membrane creates a pressure for removing the wellbore liquid from the well, the pumped fluid separated from the wellbore liquid by at least the membrane and the pumped fluid cooling the electric motor; and removing the wellbore liquid from the well using the pressure.

2. The method of claim 1, wherein expanding and contracting the first membrane comprises expanding and contracting a second membrane, wherein the second membrane expands during the contract cycle of the first membrane, and wherein the second membrane contracts during the expand cycle of the first membrane.

3. The method of claim 2, wherein the fluid expands the first membrane and the second membrane.

4. The method of claim 1, wherein expanding and contracting the first membrane comprises expanding and contracting a second membrane, wherein expanding the first membrane is used at least in part to push the wellbore liquid at least a threshold distance towards a surface region, and wherein expanding the second membrane is used at least in part to push the wellbore liquid at least a threshold distance towards a surface region.

5. The method of claim 1, wherein pumping the fluid with the pump to expand and contract the first membrane comprises continuously running the pump in a single direction.

6. The method of claim 1, further comprising (i) equalizing pressure across the hydraulic seal, (ii) unseating the pump from the hydraulic seal, and (iii) removing the pump from within the wellbore tubing, using the electric cable.

7. The method of claim 1, further comprising:

changing the operational speed of the pump to obtain a desired wellbore liquid lift volumetric throughput.

8. The method of claim 1, wherein positioning the pump downhole comprises deploying the pump with an electrical conduit and supporting the pump with the electrical conduit, and wherein electrically powering the pump comprises providing power to the pump via the electrical conduit.

9. An apparatus for removing wellbore liquid from a wellbore that extends within a subterranean formation, comprising:

an electrical power inlet;

an electric motor coupled to the electrical power inlet;

a hydraulic pump operatively coupled to the electric motor, the hydraulic pump including a pump intake and a pump discharge and the hydraulic pump and electric motor being deployable within a wellbore tubular;

a membrane configured to expand and contract within the wellbore, wherein the membrane is further configured to provide a boundary between the wellbore liquid on one side and a hydraulic fluid for the hydraulic pump on the other, the hydraulic fluid for expanding and contracting the membrane and for cooling the hydraulic pump and electric motor;

an electric cable connectable to the power inlet, the electric cable powering the electric motor and providing positioning and removal of the electric motor and hydraulic pump within the wellbore tubular; and a seal area for forming a hydraulic seal within the wellbore tubular between the hydraulic pump intake and discharge when the apparatus is positioned within the wellbore tubular.

10. The apparatus of claim 9, further comprising:

a component for directing a membrane expansion fluid into and out of the membrane, wherein the component is configured to direct at least a first portion of the membrane expansion fluid into the membrane in a first position and direct at least a second portion of the membrane expansion fluid out of the membrane in a second position; and a controller configured to switch the component between the first position and the second position.

11. The apparatus of claim 9, further comprising a second membrane configured to expand and contract within the wellbore, wherein the second membrane is further configured to provide a boundary between the wellbore liquid on one side and the pump on the other, and wherein the pump side of the boundary of the second membrane is in fluid communication with the pump side of the boundary of the membrane.

12. The apparatus of claim 11, further comprising:

a component for directing a membrane expansion fluid into and out of the first membrane and the second membrane, wherein the component is configured to direct at least a first portion of the membrane expansion fluid from the first membrane into the second membrane in a first position and direct at least a first portion the membrane expansion fluid from the second membrane into the membrane in a second position; and a controller configured to switch the component between the first position and the second position.

13. The apparatus of claim 9, wherein the pump is a pump selected from a group consisting of: diaphragm pumps, membrane pumps, reciprocating pumps, gerotor pumps, internal gear pumps, external gear pumps, triple screw pumps, axial piston pumps, rotary vane pumps, radial piston pumps, and centrifugal pumps.

14. The apparatus of claim 9, wherein the motor is selected from a group consisting of: alternating current (AC) induction motors, permanent magnet motors, brushed direct current (DC) motors, and brushless DC motors.

15. The apparatus of claim 14, wherein the motor is an AC induction motor or a DC motor, and wherein the apparatus further comprises a variable-speed drive (VSD).

16. The apparatus of claim 9, wherein the electrical power inlet is configured to receive electrical power from a battery and from an electrical conduit.

17. A system for removing a wellbore liquid from a well, comprising: a wellbore that extends between a surface region and a subterranean formation; a downhole hydraulic pump located at a desired vertical distance from the surface region, wherein the downhole pump comprises a membrane configured to expand and contract within the wellbore, wherein the membrane is further configured to provide a boundary between the wellbore liquid on one side and a hydraulic fluid for the downhole hydraulic pump on the other, and wherein the expansion and contraction of the membrane provides motive force to cause the wellbore liquid to move from downhole towards the surface region, the hydraulic pump operable connected to an electric motor, the hydraulic pump including a pump intake and a pump discharge and the hydraulic pump and electric motor being deployable within a wellbore tubular; an electric cable connectable to a power inlet for the electric motor, the electric cable powering the electric motor and providing positioning and removal of the electric motor and hydraulic pump within the wellbore tubular; and a seal area for forming a hydraulic seal within the wellbore tubular between the hydraulic pump intake and discharge when the apparatus is positioned within the wellbore tubular; at least one sensor coupled to the downhole pump and configured to detect a downhole parameter; and a motor controller configured to control the motor based at least in part on the downhole parameter detected by the at least one sensor.

18. The system of claim 17, wherein the pump further comprises a second membrane configured to expand and contract within the wellbore, wherein the second membrane is further configured to provide a boundary between the wellbore liquid on one side and the hydraulic fluid for the pump on the other, and wherein the pump side of the boundary of the second membrane is in fluid communication with the pump side of the boundary of the membrane.

19. The system of claim 18, further comprising:

a component coupled to the pump and configured to direct a membrane expansion fluid into and out of the membrane and the second membrane, wherein the component is configured to direct at least a first portion of the membrane expansion fluid from the membrane into the second membrane in a first position and direct at least a second portion the membrane expansion fluid from the second membrane into the membrane in a second position, and wherein the controller is configured to switch the component from the first position to the second position.

20. The system of claim 19, wherein the controller is configured to switch the component from the first position to the second position without changing the direction of pump flow.

21. The system of claim 20, wherein the controller comprises a variable-speed drive (VSD), and wherein controlling the motor based at least in part on the downhole parameter detected by the at least one sensor the controller comprises changing an operational speed of the pump using the VSD.

* * * * *